343-700 MS AU 251 EX
11/18/86 OR 4,623,893

United States Patent [19]
Sabban

[11] Patent Number: 4,623,893
[45] Date of Patent: Nov. 18, 1986

[54] MICROSTRIP ANTENNA AND ANTENNA ARRAY

[75] Inventor: Albert Sabban, Kiryat Yam, Israel

[73] Assignee: State of Israel, Ministry of Defense, Rafael Armament & Development Authority, Haifa, Israel

[21] Appl. No.: 558,433

[22] Filed: Dec. 6, 1983

[51] Int. Cl.[4] ..... H01Q 1/38
[52] U.S. Cl. ..... 343/700 MS; 343/829
[58] Field of Search ..... 343/700 MS, 846, 829

[56] References Cited

U.S. PATENT DOCUMENTS 4,477,813 10/1984 Weiss ..... 343/700 MS

FOREIGN PATENT DOCUMENTS 2046530 11/1980 United Kingdom ..... 343/700 MS

OTHER PUBLICATIONS

Carver et al, IEEE Trans. on Antennas and Propagation, vol. AP-29, No. 1, Jan. 1981, "Microstrip Antenna Technology", pp. 2-24.

Johnson et al., "Antenna Engineering Handbook", 2nd edition, 1984, ch. 7, pp. 7-7 to 7-9.

*Primary Examiner*—Eli Lieberman
*Assistant Examiner*—Michael C. Wimer
*Attorney, Agent, or Firm*—Benjamin J. Barish

[57] ABSTRACT

A microstrip antenna comprises a first dielectric layer having a permittivity of 2.5-12.5 carrying the ground plane on one face and a feeder-resonator on the opposite face; a second dielectric layer thereover having a permittivity of 2.2-2.5 and carrying on its outer face a radiator electromagnetically coupled to the feeder-resonator; and spacing means spacing the second dielectric layer from the first a distance of up to seven times the thickness of the first, and providing a permittivity between the two dielectric layers which is approximately that of air. Matching of the antenna is obtained by varying the spacing between the two dielectric layers. The gain of the radiating element is better than 7.5 dbi for bandwidth of 15%. Sidelobe level is less than 15 dB in azimuth and elevation plan. The radiation pattern of the antenna is symmetric in both azimuth and elevation plan.

7 Claims, 4 Drawing Figures

FIG.1
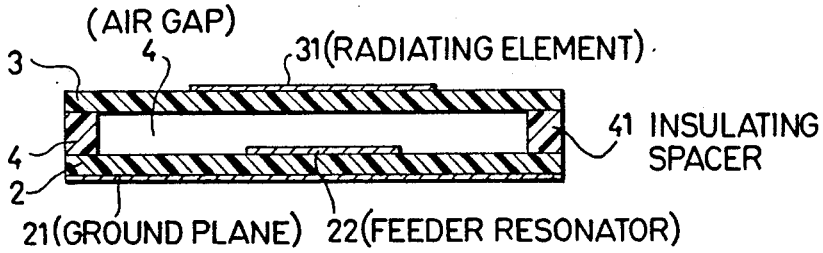
FIG.2
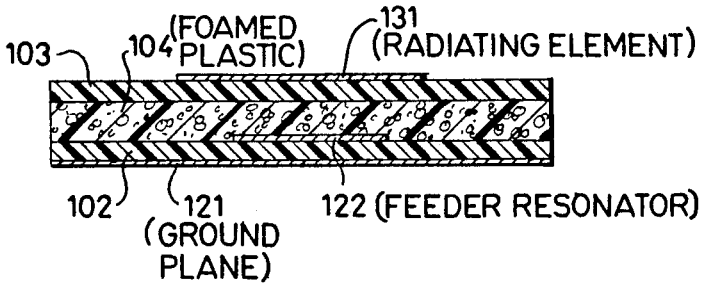
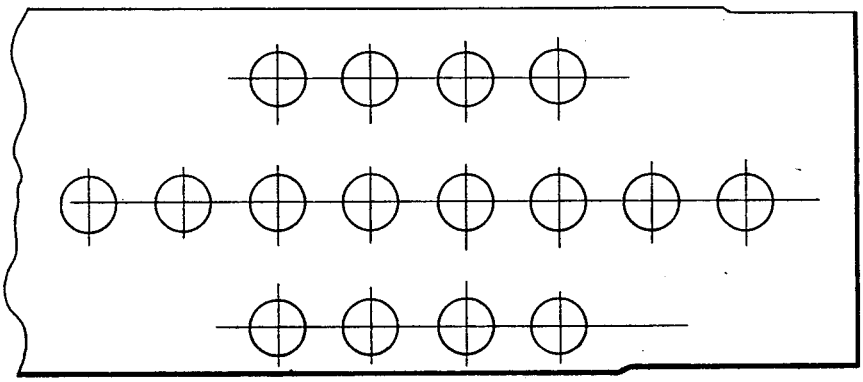
FIG.3
FIG.4
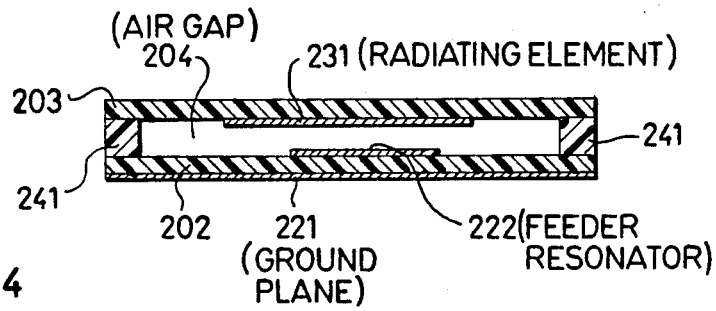

MICROSTRIP ANTENNA AND ANTENNA ARRAY

BACKGROUND OF THE INVENTION

The present invention relates to microstrip antennas, and also to microstrip antenna arrays.

Microstrip antennas have been enjoying a growing popularity lately. They possess attractive features such as low profile, light weight and small volume, combined with capability of conforming to complex bodies and low production cost. In addition, the benefit of a compact and low cost feed network may be attained by integrating the microstrip feed structure with the antenna on the same substrate. This is especially useful in arrays. These antennas, however, have a narrow bandwidth, of the order of 2–4 percent.

SUMMARY OF THE PRESENT INVENTION

An object of the present invention is to provide a microstrip antenna having an increased bandwidth.

According to a broad aspect of the present invention, there is provided a microstrip antenna comprising: (a) a first dielectric layer carrying on one face an electrically-conductive element serving as the ground plane, and on its opposite face an electrically-conductive element serving as a feeder-resonator; (b) a second dielectric layer over said first dielectric layer and of a lower permittivity than said first dielectric layer, said second dielectric layer carrying an electrically-conductive element serving as a radiator electromagnetically coupled to said feeder resonator of the first dielectric layer; and (c) spacing means spacing said second dielectric layer from said first dielectric layer and providing a permittivity therebetween which is lower than that of said second dielectric layer. The radiator is parallel to, concentric with, and of larger dimensions than, the feeder-resonator so as to completely overlie it. The spacing between the two dielectric layers is equal to at least twice the thickness of the first dielectric layer, and the permitivity of the space is between 1 and 2.2.

In the preferred embodiments of the invention described below, the first dielectric layer has a permittivity of 2.5–12.5, the second dielectric layer has a permittivity of 2.2–2.5, and the permittivity of the space between the two dielectric layers is 1–2.2, preferably as close to 1 (that of air) as possible.

In one described preferred embodiment, the spacing means comprises spacer elements at discrete points between the two dielectric layers to provide mostly an air spacing therebetween; and in a second described embodiment, it comprises a layer of foamed plastic material. Impedence matching is effected by varying the dimensions of this spacing means, and it is possible to thus space the two dielectric layers up to seven times the thickness of the first dielectric layer carrying the ground plane and feeder-resonator.

Electromagnetically-coupled microstrip radiators have been previously described in the literature, e.g., H. G. Oltman and D. A. Huebner, "Electromagnetically Coupled Microstrip Dipoles." *IEEE Trans. Antennas Propagat,* Vol. AP-29, No. 1, pp. 151–157, January 1981. Described in this publication are constructions wherein dipole radiating elements are closely stacked to microstrip feed lines. Bandwidths obtained in this manner were between 2.5° and 5.5° for a VSWR of 1.92 or better. Other "piggyback" antennas described in this literature, for example, R. J. Mailloux, J. F. McIlvenna, and N. P. Kernweis, "Microstrip Array Technology," *IEEE Trans. Antennas Propagat,* Vol. AP-29, No. 1, pp. 25–37, January 1981; S. A. Long and M. D. Walton, "A Dual-Frequency Stacked Circular Disc Antenna," *IEEE Trans. Antennas Propagat,* Vol. AP-27, No. 2, pp. 270–273, March 1979, have operated as dual-frequency radiators. As distinguished from these constructions, however, the antennas of the present invention, as described below, appear to merge the two different frequency ranges into a single wider range.

At this point, reference may be made to the publication, A. Sabban, "A Wideband Two Layer Microstrip Disc Antenna Array." (RAFAEL, Haifa, Israel). Electrotechnology for Development. *Proceedings of MELECON* 81, the First Mediterranean Electrotechnical Conference. Tel-Aviv, Israel. May 24–28, 1981, describing earlier work leading to the present invention. This publication does not describe, among other things, providing the spacing "air" layer between the two dielectric layers, but rather effects impedence matching by sliding one dielectric layer with respect to the other. Whereas the experimental constructions described in that publication increased the bandwidth for VSWR 2:1 by 10%, the present invention, including the "air-gap" spacing layer has been found to increase this bandwidth up to about 15%.

Further features and advantages of the invention will be apparent from the description below.

BRIEF DESCRIPTION OF THE DRAWINGS

The invention is illustrated, by way of example only, in the accompanying drawings, wherein:

FIG. 1 is a sectional view illustrating one form of microstrip antenna constructed in accordance with the present invention;

FIG. 2 is a view similar to that of FIG. 1, but illustrating a second form of microstrip antenna constructed in accordance with the invention;

FIG. 3 is a top plan view illustrating the invention embodied in an antenna array; and FIG. 4 illustrates a variation in the antenna of FIG. 1.

DESCRIPTION OF THE PREFERRED EMBODIMENTS

The microstrip antenna illustrated in FIG. 1 comprises a first dielectric layer 2 and a second dielectric 3 overlying dielectric layer 2 and spaced therefrom by a substantially air-gap spacing 4.

More particularly, dielectric layer 2 carries on its underface an electrically-conductive layer 21 serving as the ground plane, and further carries on its opposite face an electrically-conductive element 22 serving as a feeder-resonator. The permittivity of dielectric layer 2 is preferably from 2.5 to 12.5.

Dielectric layer 3 is formed on its outer face, namely, that opposite to dielectric layer 2, with an electrically-conductive element 31 serving as a radiator which electromagnetically coupled to the feeder-resonator 22 of dielectric layer 2. The permittivity of dielectric layer 3 is lower than that of dielectric layer 2, being preferably within the range of 2 to 2.5. Radiator element 31 is concentric to but of a large dimension than the feeder-resonator 22. Both may be conveniently formed by printed-circuit techniques.

In the construction illustrated in FIG. 1, the air-gap 4 between dielectric layers Z and 3 is formed by a plurality of spacer elements 41 at discrete points, e.g. at the corners, between dielectric layers 2 and 3, to provide mostly an air spacing between them. The spacer elements 41 should also be of low permittivity, since the permittivity of the complete space 4 between the two dielectric layers 2 and 3 should be less than that of dielectric layer 3, and preferably as close to that of air (permittivity of 1), as possible.

The thickness of the air gap 4 may be varied to match the impedence of the antenna with respect to the circuit to which it is connected. Preferably, this thickness should be at least four times that, and no greater than seven times that, of the thickness of dielectric layer 2. Particularly good results have been obtained when the thickness of this air gap layer 4 is six times that of the dielectric layer 2.

The feeder-resonator element 22 and radiator element 31 may take various configurations, such as discs of circular, square, or rectangular configuration. Best results have been obtained when these elements are symmetric, e.g. concentric discs. Particularly good results have been obtained when the diameter of the feeder-resonator element 22 is approximately 0.9 times the diameter of the radiator element 31.

The spacing between the radiator element 31 and feeder-resonator 22 may be adjusted experimentally for the best impedence match over a wide frequency range. As a practical matter, the impedence value at the center frequency may be close to 50 ohms, thus making convenient integration with their feed network and the RF head possible.

The feeder-resonator element 22 is designed as a resonator at the center frequency. Its substrate may be about 0.01, the wavelength thickness, and it may be fed by a single line for linear polarization, or by a combination of two lines in phase quadrature and with angular separation of 90° between them for circular polarization.

Table 1 below sets forth experimental results obtained with a microstrip antenna according to the above-described construction as illustrated in FIG. 1.

For a VSWR (Voltage Standing Wave Ratio) of 2:1 or better, results listed in Table 1 show bandwidths of 9 to 15 percent, depending on the configuration. Also shown in Table 1 are beamwidths, gain values, and sidelobe levels for all versions. One may note that the aperture efficiency of these antennas is better than that of ordinary microstrip antennas whose beamwidth is of the order of 85°-90°.

TABLE 1

| Antenna Geometry | Frequency Band | Bandwidth | Beamwidth H-Plane (Degrees) | Gain (dbi) | Sidelobe levels H-Plane (dB) | Pola Polarization |
|---|---|---|---|---|---|---|
| Circular disc | S | 15% | 72 | 7.9 | −22 | Linear |
| Circular annular disc | S | 11.5% | 78 | 6.6 | −14 | Linear |
| Rectangular | S | 9% | 70 | 7.4 | −25 | Linear |
| Square | S | 9% | 72 | 7 | −22 | Linear |
| Circular disc | S | 10% | 72 | 7.5 | −22 | Circular |
| Circular disc | X | 15% | 72 | 7.5 | −25 | Circular |

The antenna described above is most suitable for use as an array element. The feeding elements may be etched jointly with the power dividing network as an integrated structure, leading to a very compact, lightweight and low loss design. This is particularly important for mm wave applications. An array designed with this element achieves a lower sidelobe level as compared to conventional elements, owing to this element's higher directivity.

FIG. 2 illustrates a variation which also includes two dielectric layers 102 and 103 separated by an air-gap layer 104, layer 102 carrying a ground plane 121 on one face and a feeder resonator element 122 on the opposite face, and dielectric layer 103 carrying a radiator element 131 on its other face, all as described above with respect to FIG. 1. In FIG. 2, however, the air-gap 104 is produced by a layer of foamed plastic or rubber, such that the permittivity of this layer 104 is less than that of layer 103, preferably approach that of air, namely "1."

For purposes of example, FIG. 3 illustrates an antenna array, including 16 elements 200, in each of which the feeder-resonator and radiator are of the disc-configuration, as described above. In this example, the spacing between the elements in the array was chosen as 0.78λ, so as to attain the sidelobe level of −21 dB at the E-plane. In contrast, a cosθ element would bring about a sidelobe level of −16 dB with the same spacing. Results for several versions are shown in Table 2.

TABLE 2

| No. of Elements | Frequency Band | Bandwidth | Gain (dbi) |
|---|---|---|---|
| 16 | Ku | 10% | 18.5 |
| 32 | Ku | 9.4% | 20.5 |
| 16 | C | 13.7% | 17 |
| 64 | Ka | 10% | 23.5 |

FIG. 4 illustrates a variation in the antenna of FIG. 1, in which variation the radiating element, therein designated 231, is formed on the inner face of the upper dielectric layer 203, rather than on its outer face as in FIG. 1. The remaining elements of the antenna, namely, the lower dielectric layer 202, the ground plane 221, the feeder resonator 222, and the spacer elements 241, are the same as the corresponding elements in the FIG. 1 antenna, the FIG. 4 antenna also defining an air gap 204 between the two dielectric layers 202 and 203. The advantage in the FIG. 4 variation is that the radiating element 231, as well as the feeder resonator 222, is not exposed externally of the antenna and is protected by its dielectric layer 203.

It will be appreciated that the variation illustrated in FIG. 4, namely, of providing the radiating element 231 on the inner face of the upper dielectric layer 203 rather than on its outer face, could also be incorporated in the FIG. 2 variation wherein the air space is formed by the foamed plastic layer 104.

Following are examples of the materials that can be used for the various elements of the described antennas:

For the lower dielectric layer 2 in FIG. 1 (and the corresponding layers 102 and 202 in FIGS. 2 and 4, respectively), there may be used the ceramic-polytetrafluoroethylene-composite "RT-DUROID" (Reg. T.M.) 6010, supplied by Rogers Corporation, having a permittivity of 10.5; or "Epsilam 10" (Reg. T.M.) supplied by 3 M Company, having a permittivity of 10.2. For the upper dielectric layer 3 in FIG. 1 (and the corresponding layers 103 and 203 in FIGS. 2 and 4, respectively), there may be used the glass-microfiber-reinforced-polytetrafluoroethylene "RT-DUROID" (Reg. T.M.) 5880, supplied by Rogers Corporation, having a permittivity of 2.2, or "3 M Brand A-6098 Teflon" (Reg. T.M.) glass-cloth-laminate-type GT, supplied by 3M Company, having a permittivity of 2.5. For the spacer elements 41 in FIG. 1 (and 241 in FIG. 4), there may be used polytetrafluoroethylene "CuFlon" (T.M.) supplied by DuPont, having a permittivity of 2.1, or glass-reinforced-polypropylene, having a permittivity of 2.36. For the foamed plastic layer 104 in FIG. 2, there may be used foamed-polyurethane having a dielectric constant of 1.04–2.4, or foamed-polypropylene having a dielectric constant of 2.2–2.4.

It will thus be seen that the above-described antennas effect matching by varying the spacing between the two dielectric layers and provide a gain of the radiating elements better than 7.5 dbi for bandwidth of 15%, the sidelobe level being less than 15 dB in azimuth and elevation and the radiation pattern being symmetrical in both azimuth and elevation planes.

Many other variations and applications of the invention will be apparent.

What is claimed is:

1. A microstrip antenna of wide bandwidth comprising:

(a) a first dielectric layer carrying on one face an electrically-conductive element serving as the ground plane, and on its opposite face an electrically-conductive element serving as a feeder-resonator;

(b) a second dielectric layer over said first dielectric layer and of a lower permittivity than said first dielectric layer, said second dielectric layer carrying a single electrically-conductive element overlying said feeder-resonator and serving as a single radiator electromagnetically coupled to said feeder-resonator of the first dielectric layer, said radiator being parallel to, concentric with, of the same geometrical shape as, and of larger dimensions than, said feeder-resonator so as to completely overlie same; and (c) spacing means spacing said second dielectric layer from said first dielectric layer at a distance equal to at least twice the thickness of said first dielectric layer and providing a permittivity therebetween which is between 1 and 2.2 and is lower than that of said second dielectric layer.

2. The antenna according to claim 1, wherein said spacing means spaces the second dielectric layer from the first dielectric layer from two to seven times the thickness of the first dielectric layer.

3. The antenna according to claim 1, wherein said feeder-resonator and said radiator are of circular-disc configuration, said feeder-resonator having a diameter equal to approximately 0.9 times the diameter of the radiator.

4. The antenna according to claim 1, wherein said feeder-resonator is fed by a single line for linear polarization.

5. The antenna according to claim 1, wherein said first dielectric layer carries a plurality of discrete feeder-resonators, and said second dielectric layer carries a plurality of radiators concentric to the feeder-resonators of the first dielectric layer, such as to produce an antenna array.

6. The antenna according to claim 1, wherein said electrically-conductive element serving as the radiator is carried on the outer face of said second dielectric layer.

7. The antenna according to claim 1, wherein said electrically-conductive element serving as the radiator is carried on the inner face of said second dielectric layer.

* * * * *